US006283626B1

(12) United States Patent
Lim et al.

(10) Patent No.: US 6,283,626 B1
(45) Date of Patent: Sep. 4, 2001

(54) MULTIPHASE MIXING APPARATUS USING ACOUSTIC RESONANCE

(75) Inventors: Jong-Yun Lim; Jong-Duck Moon, both of Kyeongki-Do (KR)

(73) Assignee: Institute for Advanced Engineering, Seoul (KR)

( * ) Notice: Subject to any disclaimer, the term of this patent is extended or adjusted under 35 U.S.C. 154(b) by 0 days.

(21) Appl. No.: 09/165,338

(22) Filed: Oct. 2, 1998

(51) Int. Cl.[7] ..... B01F 15/02; B01F 5/00

(52) U.S. Cl. ..... 366/165.2; 366/108

(58) Field of Search ..... 366/165.1, 165.2, 366/165.4, 165.5, 124, 108, 192, 338, 339, 116, 119; 137/828, 808, 812, 813

(56) References Cited

U.S. PATENT DOCUMENTS 2,634,109 * 4/1953 Zachariassen ..... 366/165.1
3,108,743 * 10/1963 Naugle .
3,108,749 * 10/1963 Drayer et al. ..... 366/124
3,731,877 * 5/1973 Nekrasov et al. ..... 366/165.1
3,849,075 * 11/1974 Albright et al. ..... 366/165.1
3,911,858 * 10/1975 Goodwin .
3,917,233 * 11/1975 Blower .
4,053,142 * 10/1977 Johnnes ..... 366/165.1
4,131,134 * 12/1978 Lindberg .
4,205,786 * 6/1980 Babich et al. .
4,415,275 * 11/1983 Dietrich ..... 366/165.1
4,534,655 * 8/1985 King et al. .
4,726,686 * 2/1988 Wolf et al. ..... 366/165.1
4,790,666 * 12/1988 Koziol ..... 366/165.1
4,861,165 * 8/1989 Fredriksson et al. ..... 366/165.1
5,032,027 * 7/1991 Berliner, III .
5,060,867 * 10/1991 Luxton et al. .
5,437,784 * 8/1995 Meinecke et al. .
5,492,654 * 2/1996 Kozjuk et al. .
5,520,459 * 5/1996 Yu et al. .
5,836,683 * 11/1998 Moon et al. .
5,975,750 * 11/1999 Semp et al. .
6,027,241 * 2/2000 King .
6,035,897 * 3/2000 Kozyuk .

* cited by examiner

*Primary Examiner*—Tony G. Soohoo
(74) *Attorney, Agent, or Firm*—Jacobson Holman, PLLC

(57) ABSTRACT

A multiphase mixing apparatus using acoustic resonance. The apparatus can induce a pressure difference between fluids to be mixed so that a resonance and an acoustic energy are generated, thereby shattering the fluids and effectively mixing them. The shattered gas fluid penetrating into the liquid fluid goes along a swirl flow so that the gas fluid stays in the liquid fluid for a relatively long time. In addition, the acoustic energy perturbs the fluids, a mass transfer resistance decreases. The fluids can be effectively agitated not only by an acoustic energy of a resonance generated between the mixed fluids flow and a resonance volume portion but also by a resonance generated by a mixed swirl flow formed by a circular

18 Claims, 8 Drawing Sheets

MULTIPHASE MIXING APPARATUS USING ACOUSTIC RESONANCE

BACKGROUND OF THE INVENTION

1. Field of the Invention

The present invention relates to a mixing apparatus for mixing materials having different phases such as liquid and gas by using acoustic resonance.

2. Description of the Prior Art

In general, mixing devices have been used to mix materials having different phases such as liquid-gas or liquid-solid in fermenters such as for beer and microorganisms and waste water disposal processes. To effectively mix the materials, it is proper to maximize a contact area between the materials and perturb the equilibrium state therebetween so as to narrow an interface layer thickness therebetween. Particularly, when the gas to be mixed with the liquid is dispersed, the contact area therebetween widens so that the gas and liquid are effectively mixed with each other.

Note should be made of the fact that a mixing apparatus using vibration is disclosed in U.S. Pat. No. 3,108,749 entitled "Vibratory apparatus for atomizing liquids" and in U.S. Pat. No. 3,917,233 entitled "Vibrator".

FIGS. 1 and 2 also show a mixing apparatus for dispersing gas by narrowing thruholes through which gas passes. Assuming the mixing apparatus is utilized in a waste water dispersing plant, the mixing apparatus will be explained below.

FIG. 1A is a perspective view of a conventional mixing apparatus and FIG. 1B is a sectional view taken along line III—III shown in FIG. 1A.

Referring now to FIGS. 1A and 1B, pressurized air from a compressor (not shown) is supplied into a pipe 11 through a connecting portion 14 and a joint 13. Pipe 11 is made of ceramic or polyethylene, is formed with a plurality of fine holes 11*a* and is placed in waste water. The air supplied into pipe 11 is dispersed through holes 11*a* while passing through pipe 11 and penetrates into the waste water, thereby fermenting microorganisms contained in the waste water.

In the above mixing apparatus, the amount of air supplied into the waste water is determined size by the hole formed at pipe 11. However, there may be a lower limit in fining the hole size, so it cannot be always satisfied by a client.

Also, since underwater plants which inhabit in the waste water sometimes block the fine holes, the pipe must be cleaned periodically.

FIG. 2A is a sectional view of another conventional mixing apparatus and FIG. 2B is a plan view of the apparatus shown in FIG. 2A.

Referring to FIGS. 2A and 2B, pressurized air is supplied into a housing 21 through an inlet portion 21*a* by a compressor (not shown). The air then passes through an intermediate net 22 and a cover net 23 so as to disperse the air into the waste water. At this time, balls 24 float in housing 21 so as to collide with the inflowing air and also disperse the air.

However, the above mixing apparatus is also restricted in the fineness of the net meshes, so mixing efficiency is not satisfactory.

SUMMARY OF THE INVENTION

The present invention is intended to overcome the above-described disadvantages. Therefore, it is an object of the present invention to provide a material mixing apparatus which can disperse materials to be mixed by using an acoustic resonance therebetween, thereby improving mixing efficiency.

In order to achieve the above object of the present invention, there is provided a multiphase material mixing apparatus using acoustic resonance. The apparatus comprises: a housing for guiding first and second fluids to form a swirl flow, the housing having a side, upper and bottom walls so as to form a chamber having a cylindrical shape therein, being immersed within the first fluid, being formed at the side wall thereof with a helical guide portion, and being formed with a guide post extending from the lower wall thereof toward the outlet portion, the guide post being tapered to converge toward the upper wall of the housing; an inlet portion for introducing the second fluid into the chamber at a predetermined pressure and allowing the second fluid to form the swirl flow, the inlet portion including an inlet port formed at the side wall of the housing; and an outlet portion having an outlet port formed at the upper wall of the housing for expelling the swirl flow through a circumferential end portion thereof and allowing the first fluid to flow into a center portion of the swirl flow through a corresponding center portion thereof, a resonance being generated by the expelling swirl flow and the inflowing first fluid thereby generating an acoustic energy and mixing the first and second fluids.

The second fluid has a gas phase and the first fluid has a liquid phase. A resonant frequency is in a range of 2000 Hz to 3000 Hz.

A height of the chamber H, a diameter D1 of the chamber, a diameter D3 of the inlet port, an inlet pressure $P_{in}$ of the second fluid passing through the inlet port and an outlet pressure $P_{out}$ of mixed first and second fluids are designed as:

$$H/D1 \approx 0.5\sim2,\ D1/D3 \approx 5\sim8,\ \Delta P(P_{in}-P_{out}) \leq 2 \text{ bar.}$$

Also, there is provided a multiphase mixing apparatus using acoustic resonance, the apparatus comprising: a housing forming a passage therein for allowing a first fluid and a second fluid to be mixed with the first fluid to flow therethrough, the housing being immersed within the first fluid; and a resonance volume portion for generating a resonance by interacting with a mixture of the first and second fluids being expelled through an outlet port of the passage, the resonance volume portion being located adjacent to the outlet port so as to be communicated therewith.

The passage includes an inlet port being smaller than the outlet port in size, and the resonance volume portion is formed with an opening which is communicated with the outlet port and oriented in parallel with a streamline along which the mixture flows.

The passage includes an inlet passage and an outlet passage which meet at a right angle, and a circular rod is provided within and along the inlet passage for allowing the mixture to form a swirl flow therealong.

An annular space is formed between the circular rod and the inlet passage.

A plate is provided at a distal end of the inlet passage for colliding with the mixed first and second fluids.

A screw is provided at the outlet port for adjusting an opened portion of the outlet port.

The first and second fluids have liquid and gas phases respectively, and in a case where an inlet pressure of the second fluid is in ranges of 0.1 bar to 2 bar and a flowrate of 100 to 500 l/min, a resonant frequency is within a range of 1000 Hz to 5000 Hz.

The mixing apparatus can induce a pressure difference between fluids to be mixed so that resonance and acoustic energy are generated, thereby dispersing the fluids and effectively mixing them.

Also, the dispersed gas fluid penetrating into the liquid fluid goes along the swirl flow so that the gas fluid stays in the liquid fluid for a relatively long time. In addition, since the acoustic energy perturbs the fluids, a mass transfer rate increases.

In addition, the fluids to be mixed can be effectively agitated not only by an acoustic energy of resonance generated between the mixed fluids flow and the resonance volume portion but also by resonance generated by the mixed swirl flow formed by the circular rod.

BRIEF DESCRIPTION OF THE DRAWINGS

The above object and other advantages of the present invention will become more apparent by describing in detail preferred embodiments thereof with reference to the attached drawings in which.

DETAILED DESCRIPTION OF THE INVENTION

Hereinafter, material mixing apparatuses using acoustic resonance of various embodiments will be explained in more detail with reference to the accompanying figures.

All the embodiments will be described by assuming that they are utilized in a waste water disposal plant.

Embodiment 1

Figure 1A:
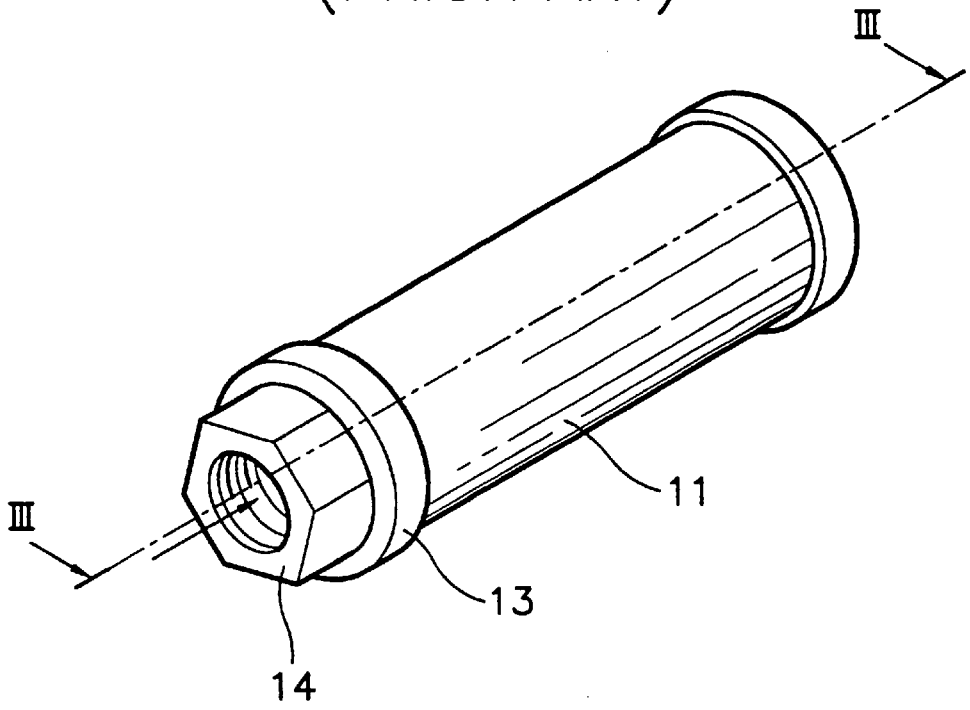
FIG. 1A (PRIOR ART)
FIG. 1A is a perspective view of a conventional mixing apparatus.
Figure 1B:
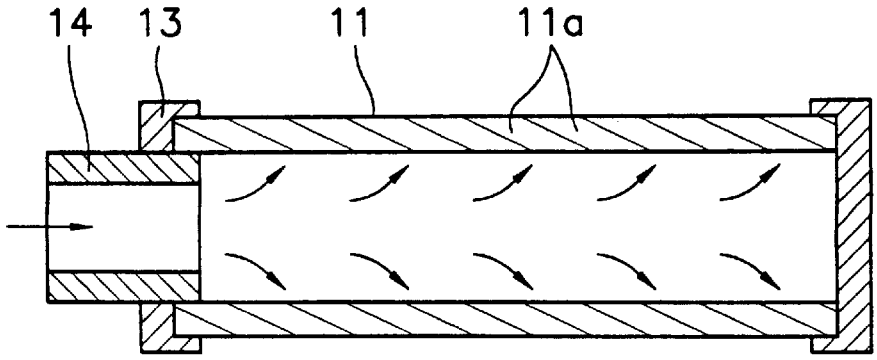
FIG. 1B (PRIOR ART)
FIG. 1B is a sectional view taken along line III—III shown in FIG. 1A.
Figure 2A:
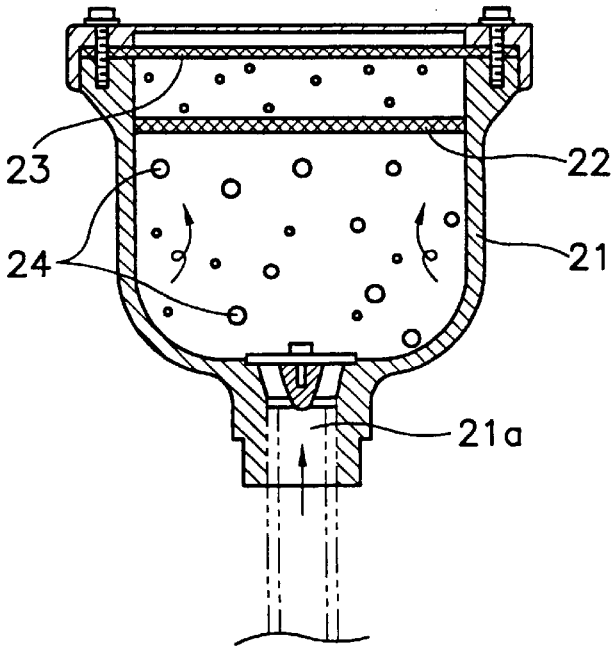
FIG. 2A (PRIOR ART)
FIG. 2A is a sectional view of another conventional mixing apparatus.
Figure 2B:
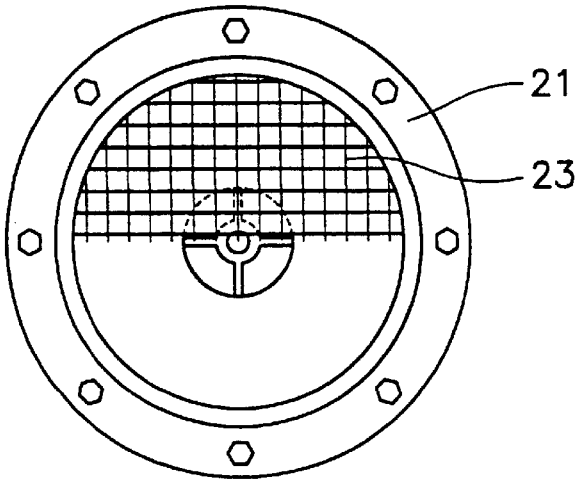
FIG. 2B (PRIOR ART)
FIG. 2B is a plane view of the mixing apparatus of FIG. 2A.
Figure 3A:
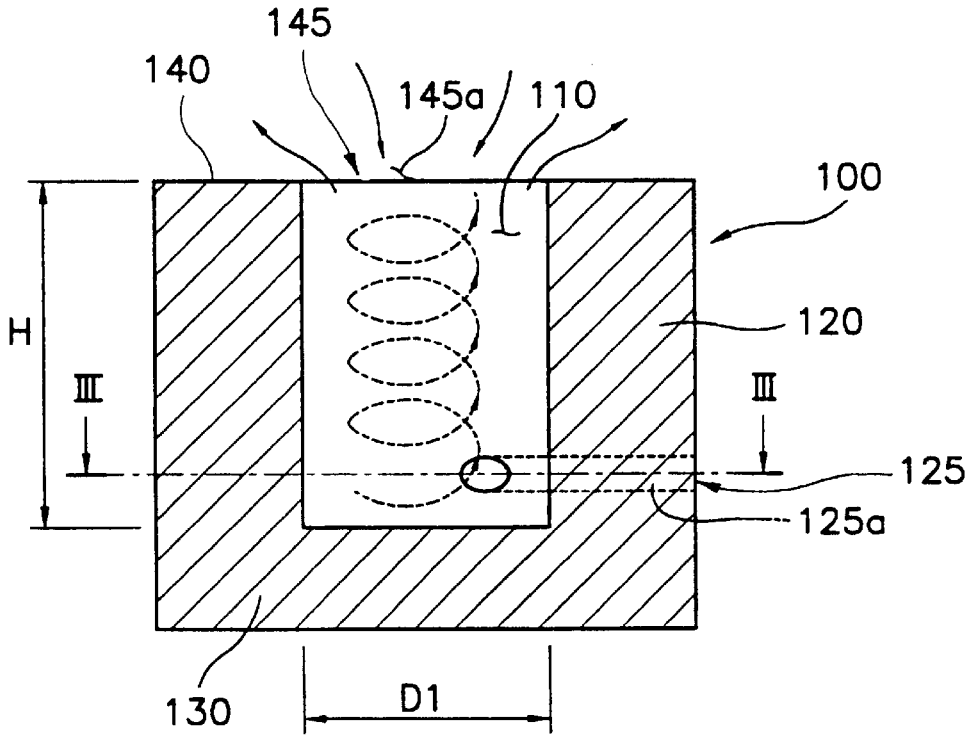
FIG. 3A is a perspective view of a mixing apparatus in accordance with a first embodiment of the invention.
Figure 3B:
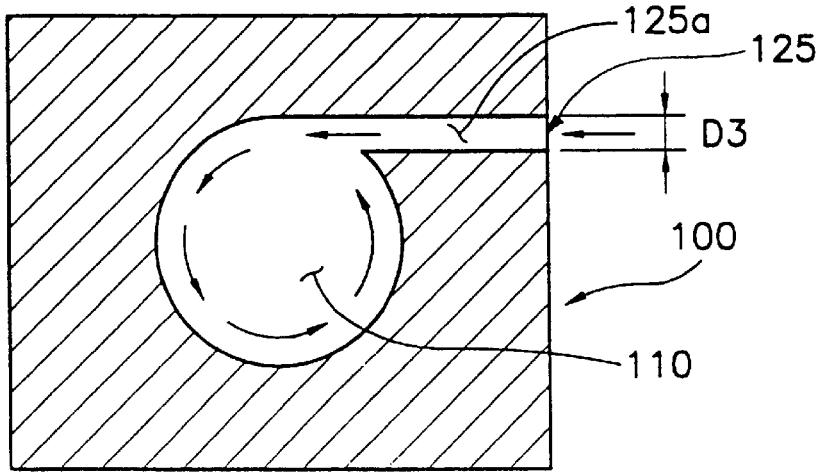
FIG. 3B is a sectional view taken along line III—III shown in FIG. 3A.

FIG. 3A is a perspective view of a mixing apparatus of a first embodiment and FIG. 3B is a sectional view taken along line III—III of FIG. 3A.

A housing 100 immersed within a first fluid which has a liquid phase and forming a chamber 110 therein is provided. Housing 100 includes side wall 120, and upper and lower walls 140 and 130 opposite each other for forming chamber 110 therebetween.

Housing 100 is formed at side wall 120 with an inlet portion 125 having an inlet port 125*a*. A second fluid having a gas phase is supplied into chamber 110 through inlet portion 125 by a compressor (not shown). Inlet portion 125 is directed tangentially into chamber 110 so that the second fluid forms a swirl flow along side wall 120 and ascends to be expelled.

Upper wall 140 of housing 100 is opened to form an outlet portion 145 having an outlet port 145*a*. That is, the second fluid flowing into chamber 110 through inlet port 125*a* is mixed with the first fluid and expelled through outlet port 145*a*. In detail, the second fluid supplied into chamber 110 by the compressor with a pressure $P_{in}$ forms a swirl flow along side wall 120 of housing 100, and is mixed with the first fluid received in chamber 110 and is thereafter expelled through outlet portion 145. At this time, the center portion of the mixed swirl flow has a lower pressure than that of the circumferential end portion so that the first fluid which surrounds housing 100 flows into the center portion of the expelled flow.

In particular, the expelled mixed flow and the inflowing first fluid are again mixed and there is generated a resonance by the pressure difference therebetween. At this time, the second fluid having a gas phase is dispersed and penetrates into the first fluid, thereby accomplishing an effective mixing.

The resonance generates an acoustic energy which facilitates penetration of the second fluid into the first fluid. In more detail, the acoustic energy disperses the second fluid, thereby increasing the contact area between the first and second fluids. Also, the dispersed second fluid penetrating into the first fluid goes along the swirl flow so that the second fluid stays in the first fluid for a relatively long time. In addition, as the acoustic energy perturbs the fluids, the mass transfer resistance decreases.

Preferably, housing 100 has a cylindrical shape. This can decrease a form drag force while the mixed fluids form a swirl flow along side wall 120.

The resonant frequency F1 is evaluated by the following equation:

$$F1 = \frac{K \times C}{\pi \times D1} \times \sqrt{P_{\text{in}} - P_{out}} \tag{1}$$

K is an experimental parameter indicating a rotational speed drop of the second fluid by a friction with the side wall of the chamber, C is a sound speed in the medium of the second fluid, D1 is a chamber diameter, $P_{in}$ is an inlet pressure of the second fluid flowing into the chamber, and $P_{out}$ is an outlet pressure of the mixed fluids expelled.

In a waste water disposal plant, since the air is the medium, C is approximately 340 m/s.

At this time, since the resonant frequency is in a proper range when it is between 2000 Hz to 3000 Hz, housing 100 can be designed to met above requirement.

For example, when the height of chamber 110 is H, the diameter of inlet port 125*a* is D3 and the flowrate of the air is in the range of 100–500 l/min, housing 100 can be designed such that H is 30 mm, D1 is 20 mm, $\Delta P$ ($P_{in}$–$P_{out}$) is below 2 bar, and the ratio of D1 to D3 (D1/D3) is in the range of 5–8. Then the resonant frequency F1 is settled in the range of 2000–3000 Hz. Preferably, D3 is designed to be 6 mm approximately.

By using housing 100 designed as above, the mass transfer efficiency of the second fluid increases to be approximately 30 percent greater than with a conventional mixing apparatus.

Mass transfer efficiency=(penetrated gas mass per time)/(supplied gas mass per time) (2).

Embodiment 2

Figure 4A:
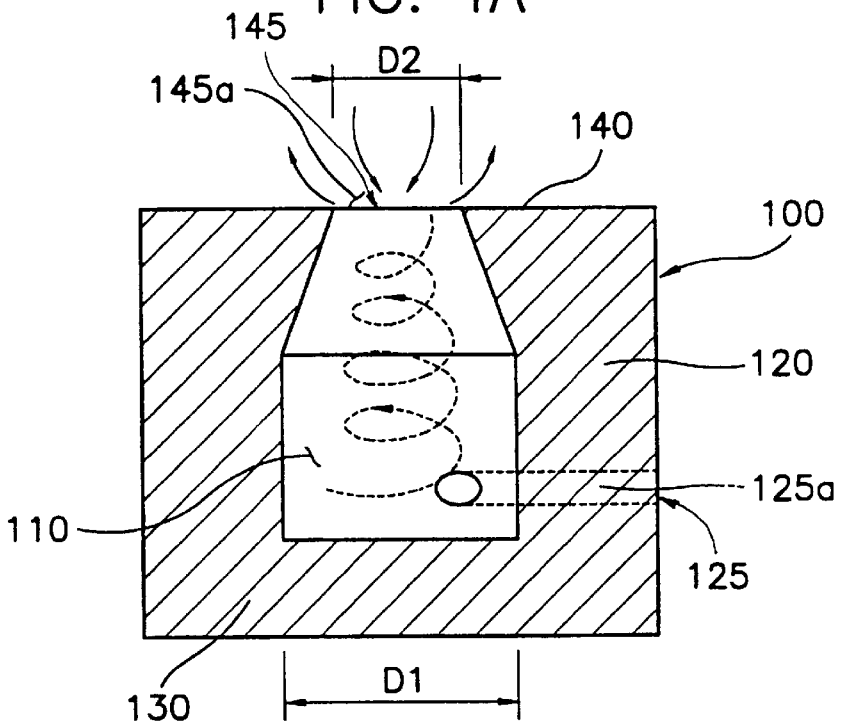
FIGS. 4A and 4B are sectional views of a mixing apparatus of a second embodiment.
Figure 4B:
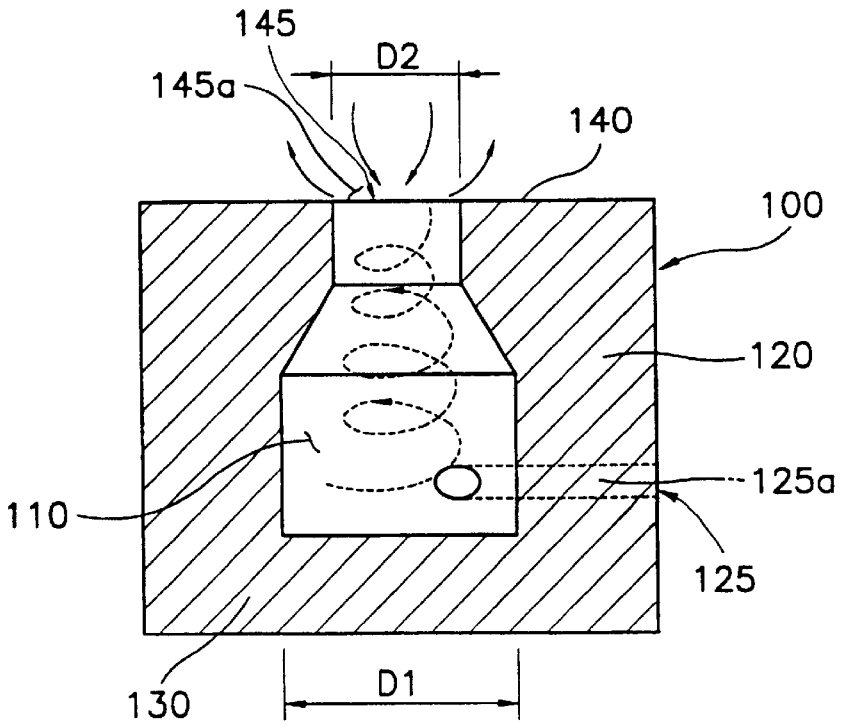

FIGS. 4A and 4B are sectional views of a mixing apparatus of a second embodiment.

The mixing apparatus of the second embodiment has the same construction as that of the first embodiment except that the diameter D2 of outlet port 145*a* is smaller than the diameter D1 of chamber 110. Thus, a pressure difference is induced between the mixed fluids expelled through outlet port 145*a* and the inflowing first fluid, thereby improving the mixing efficiency.

Outlet port 145*a* of FIG. 4A is convergingly formed, and outlet port 145*a* of FIG. 4B converges upwardly and then goes straight.

Embodiment 3

Figure 5:
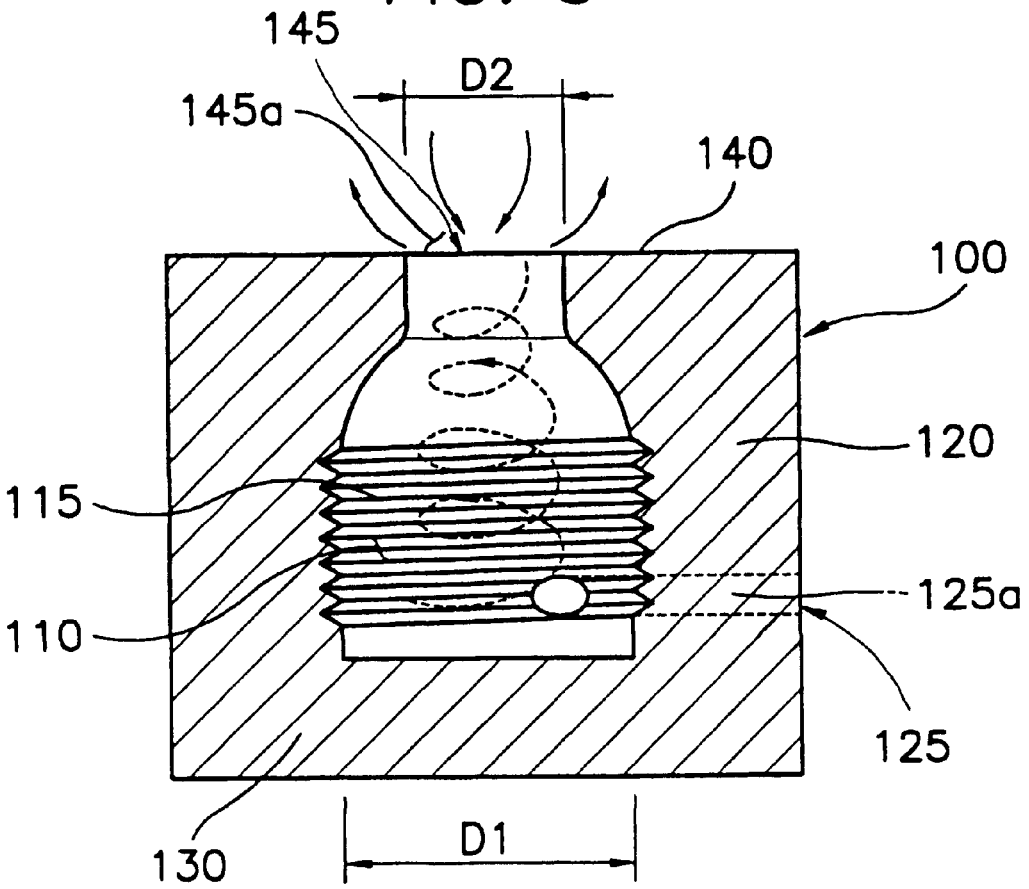
FIG. 5 is a sectional view of a mixing apparatus of a third embodiment.

FIG. 5 is a sectional view of a mixing apparatus of a third embodiment.

The mixing apparatus of the third embodiment is different from that of the second embodiment in that, referring to FIG. 5, a helical guide portion 115 is formed at the inside wall of housing 100. Guide portion 115 includes a groove or a projection formed at the inside wall which guides the second fluid flowing through inlet portion 145 and the mixed fluids to easily form a swirl flow. Thus, in the third embodiment, the flow resistance is decreased by the guide portion.

Embodiment 4

Figure 6A:
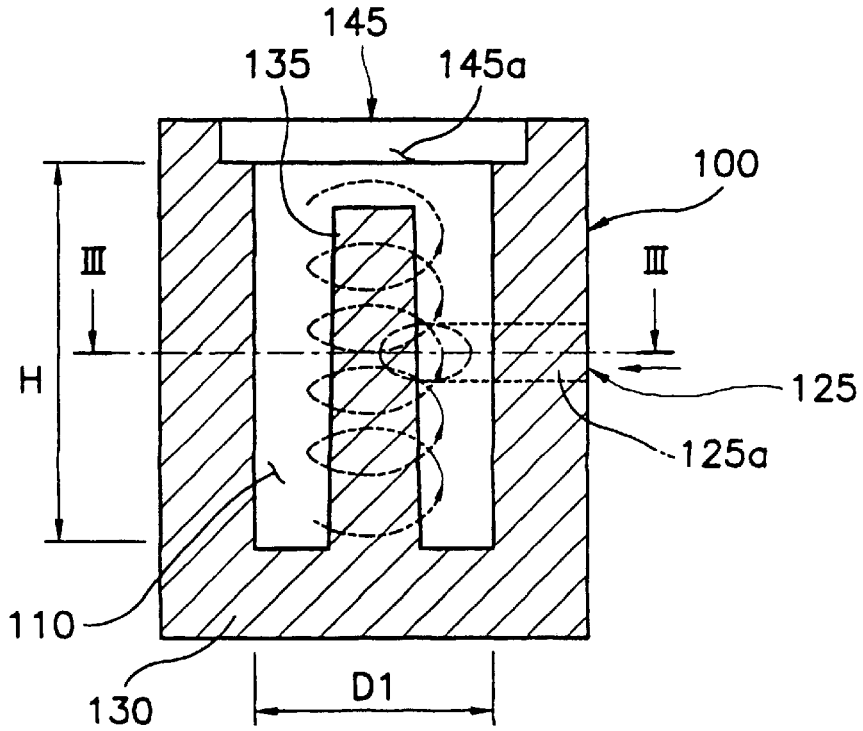
FIG. 6A is a sectional view of a mixing apparatus of a fourth embodiment.
Figure 6B:
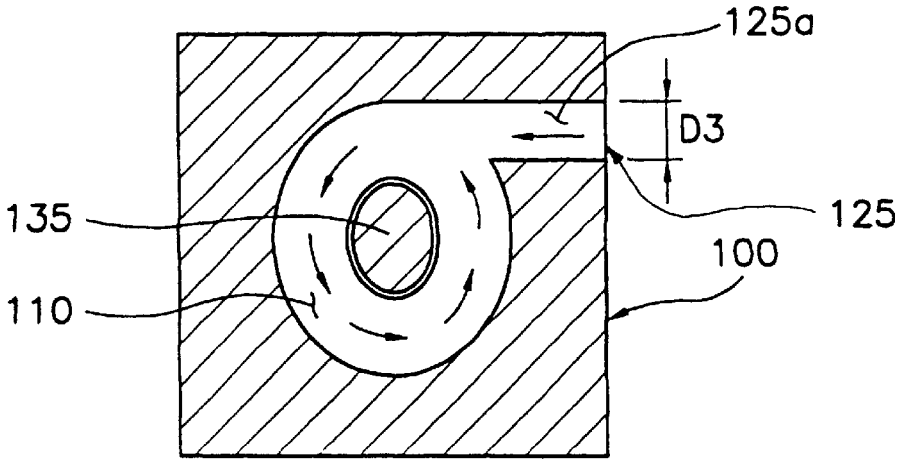
FIG. 6B is a sectional view taken along line m-r shown in FIG. 6A.

FIG. 6A is a sectional view of a mixing apparatus of a fourth embodiment and FIG. 6B is a sectional view taken along line III—III shown in FIG. 6A.

The mixing apparatus of the fourth embodiment is different from that of the first embodiment in that, referring to FIG. 5, housing 100 is formed at a center portion of lower wall 130 thereof with a guide post 135 extending toward outlet portion 145. Guide post 135 makes the mixed fluids form a swirl flow easily. For reducing the flow resistance, guide post 135 has an oval crosssection and converges toward outlet portion 145 so as to allow the first fluid to easily flow into housing 100 through outlet port 145*a*.

In designing housing 100 of the fourth embodiment, when the height of chamber 110 is H, the diameter of inlet port is D3, the diameter of chamber is D1, the inlet pressure of the second fluid $P_{in}$ and the outlet pressure of the mixed fluids is $P_{out}$, and the flowrate is in the range of 100 to 500 l/min, housing 100 is designed as:

$$H=30 \text{ mm},\ D1=20 \text{ mm},\ \Delta P \leqq 2 \text{ bar and } D1/D3 \approx 5\text{–}8.$$

In this case, the resonant frequency F1 is in the range of 2000–3000 Hz and the mass transfer rate of the second fluid increases to be up to 150 percent greater than with a conventional mixing apparatus. Preferably, D3 is designed to have a diameter of approximately 6 mm.

The mixing apparatus may have a cylindrical Helmholtz resonator which generates a resonance of a unique resonant frequency, or the mixing apparatus may be of an air jet type having a nozzle. The Helmholtz resonator is adequate for an inlet pressure lower than 1 bar and a flowrate lower than 300 l/min. The air jet resonator is adequate for an inlet pressure lower than 3 bar and a flowrate lower than 300 l/min.

Figure 7A:
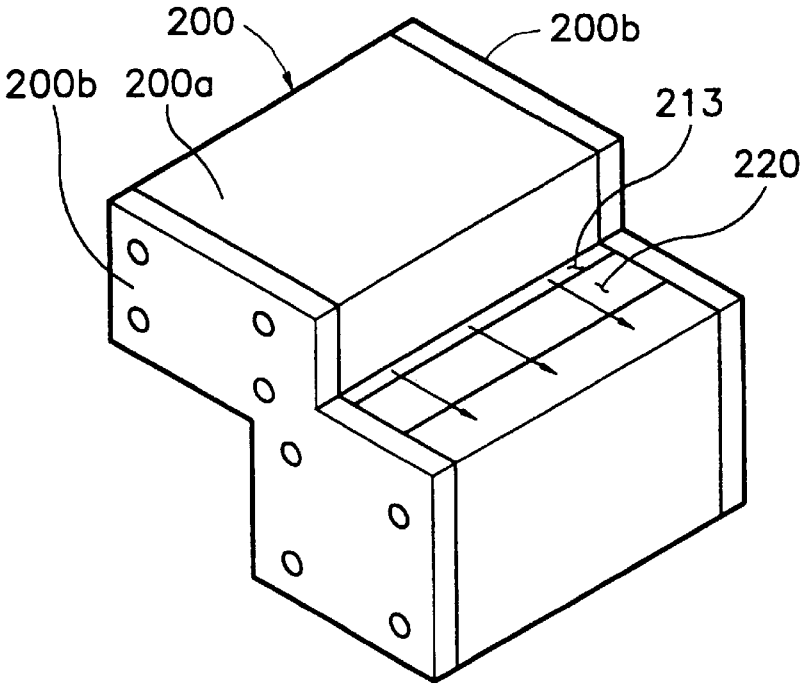
FIG. 7A is a sectional view of a mixing apparatus of a fifth embodiment.
Figure 7B:
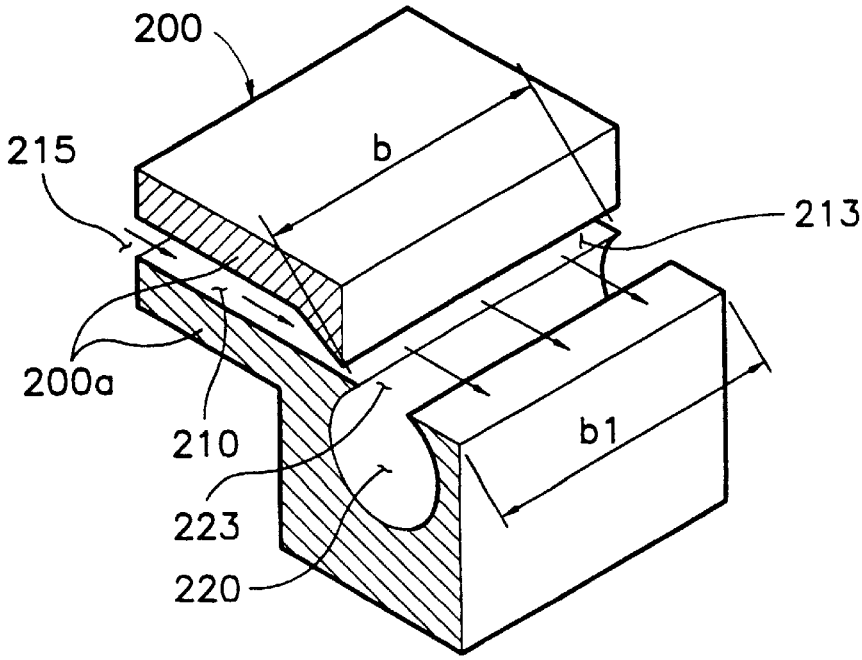
FIG. 7B is a perspective view showing an inner structure of the mixing apparatus of FIG. 7A.

Embodiment 5 FIG. 7A is a sectional view of a mixing apparatus of a fifth embodiment and FIG. 7B is a perspective view showing an inner structure of the mixing apparatus of FIG. 7A.

Referring to FIGS. 7A and 7B, a housing 200 is formed therein with a passage 210 for the first and second fluids which have liquid and gas phases respectively, and is immersed within the first fluid. Housing 200 includes a body 200*a* forming passage 210 and a couple of side plates 200*b* attached to respective sides of body 200*a*. Housing 200 is formed at a portion therein adjacent to an outlet portion 213 of passage 210 with a resonance volume portion 220 which communicates with passage 210. Resonance volume portion 220 has a cylindrical shape and is excited by interacting with mixed fluids, thereby generating a resonant acoustic energy. The acoustic energy disperses the first and second fluids and mixes them. Thus, the mass transfer rate between the first and second fluids increases.

Outlet portion 213 of passage 210 below which resonance volume portion 220 is located is narrower than an inlet portion 215. Opening 223 of resonance volume portion 220 is formed in parallel with the stream line of the mixed fluids expelled through outlet portion 213. This is for setting a state where the mixed fluids are excited with resonance volume portion 220. Preferably, a width b1 of opening 223 is identical to a width b of outlet portion 213.

In this embodiments, since the resonant frequency is in a proper range when it is between 1000 to 5000 Hz, resonance volume portion 220 of housing 200 can be designed therewith.

When the inlet pressure of the second fluid passing through inlet portion 215 is in the range of 0.1 bar to 2 bar, the flowrate is in the range of 100 l to 500 l, and the resonant frequency F2 is in the range of 1000 Hz to 5000 Hz, the mixing apparatus of the fifth embodiment is remarkably improved in the mass transfer rate.

In the fifth embodiment, the resonance is more likely to occur in the pressure range of 0.1 bar to 1.5 bar.

Embodiment 6

Figure 8:
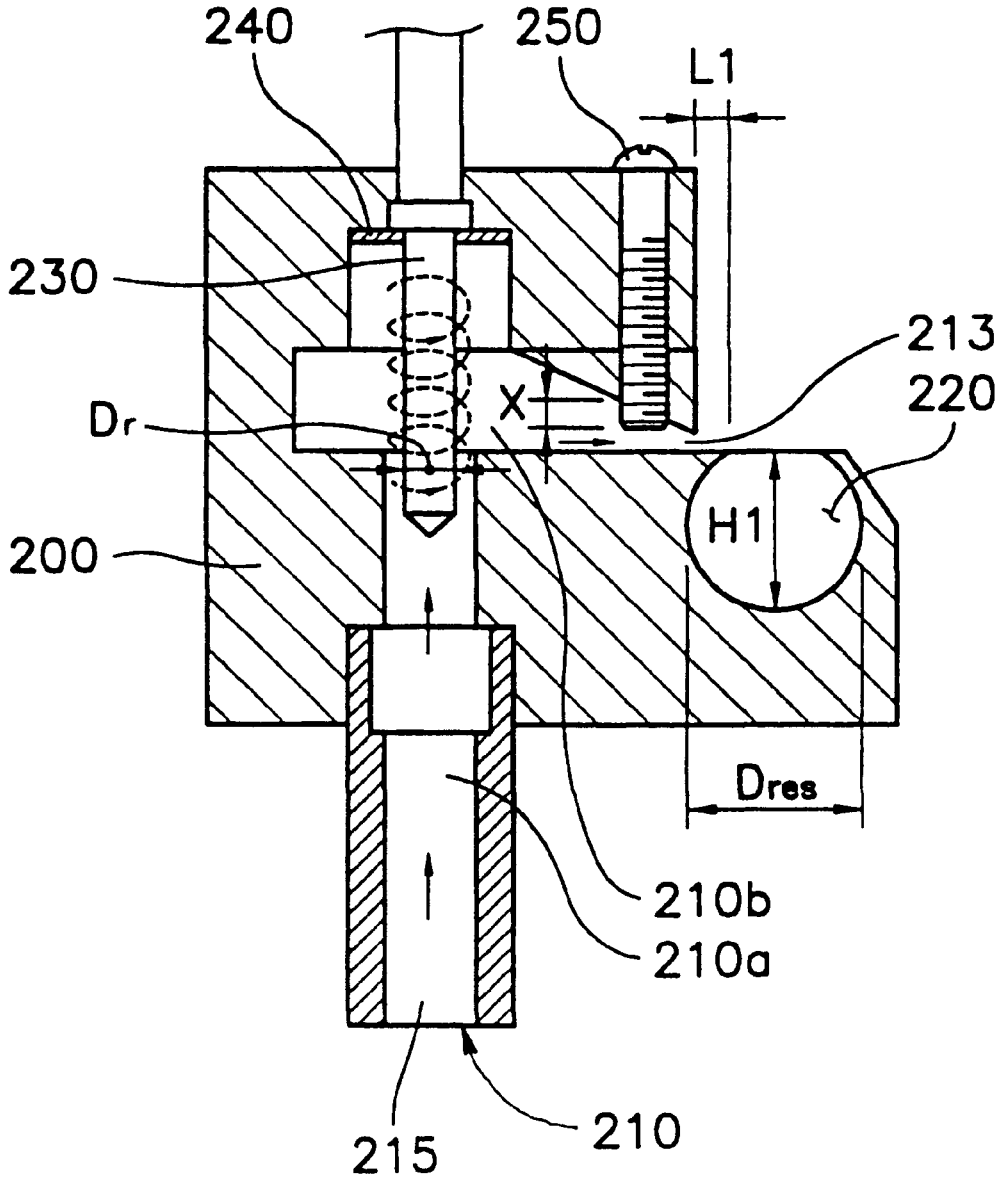
FIG. 8 is a sectional view of a mixing apparatus of a sixth embodiment.

FIG. 8 is a sectional view of a mixing apparatus of a sixth embodiment.

Only the differences from the fifth embodiment will be explained.

Referring to FIG. 8, a passage 210 having a circular cross-section includes an inlet portion 210*a* and an outlet portion 210*b* which meet at a right angle. At the crossing portion between inlet and outlet portions 210*a* and 210*b*, a circular rod 230 extends toward inlet portion 210*a* which makes the mixed fluids form a swirl flow. At this time, an annular space is formed between inlet portion 210*a* and circular rod 230, which makes it easier to form a swirl flow. Also, since circular rod 230 and inlet portion 210*a* have circular crosssections, they do not create flow resistance.

On the other hand, the size of outlet portion 213 is adjusted by a screw 250 which can protrude into outlet portion 213 by a variable distance X.

At the recessed portion adjacent to the crossing portion of passage 210, a plate 240 is provided so as to collide with the mixed fluids and urge them to flow toward outlet portion 210*b*.

The resonant frequency F3 of the resonance generated by the collision between the mixed fluids and the plate 240, the sound speed in the medium of the second fluid C, the pressure difference ΔP between the first and second fluids, the height H1 of a resonance portion, the diameter Dres of the resonance portion, the diameter Dr of the water passage through which the swirl flow develops, and the distance L1 between the outlet and an opening of the resonance portion are correlated by the following equation:

$$F3 = \frac{0.78 \times (\Delta P - 0.93)^{\frac{1}{3}} \times C}{(4 \times H1 + 0.41 \times L1 + (Dres - Dr)) \times \left(0.4 - \frac{(0.2 \times H1)}{Dr}\right)} \quad (3)$$

In particular, the diameter Dr is the diameter of the circular rod. And, since the mixing apparatus is utilized in the waste water disposal plant, C is approximately 340 m/s.

At this time, since the resonant frequency is in the proper range when it is between 1000 to 5000 Hz, resonance volume portion 220 and housing 200 can be designed to meet the above requirement. When the inlet pressure of the second fluid passing through inlet portion 215 is in the range of 0.1 bar to 2 bar, the flowrate is in the range of 100 l to 500 l, and the resonant frequency F2 is in the range of 1000 Hz to 5000 Hz, the mass transfer rate of the mixing apparatus of the sixth embodiment is remarkably improved.

In the sixth embodiment, the resonance by the air injection is more likely to happen in a pressure below 3 bar, and the resonance by resonance volume portion 220 is more likely to happen in a pressure below 2 bar. Thus, the mixing apparatus can be well utilized even when there is a pressure fluctuation from high to low or from low to high pressure.

As described above, the mixing apparatus can induce a pressure difference between fluids to be mixed so that a resonance and an acoustic energy are generated, thereby dispersing the fluids and effectively mixing them.

Also, the dispersed gas fluid penetrating into the liquid fluid goes along the swirl flow so that the gas fluid stays in the liquid fluid for a relatively long time. In addition, since the acoustic energy perturbs the fluids, the mass transfer rate increases.

In addition, the fluids to be mixed can be effectively agitated not only by the acoustic energy of the resonance generated between the mixed fluids flow and the resonance volume portion but also by the resonance generated by the mixed swirl flow formed by the circular rod.

Although the preferred embodiments of the invention have been described, it is understood that the present invention should not be limited to these preferred embodiments, but various changes and modifications can be made by one skilled in the art within the spirit and scope of the invention as hereinafter claimed.

What is claimed is:

1. A multiphase mixing apparatus using acoustic resonance, the apparatus comprising:

a housing for guiding first and second fluids to form a swirl flow, said first and second fluids being of different phases, the housing having a circular cross section with a side wall, an upper wall and a lower wall so as to form a chamber therein, the upper wall and the lower wall being perpendicular to a force of gravity, the housing immersed within the first fluid;

an inlet portion for introducing the second fluid into the chamber at a predetermined pressure so that the second fluid forms the swirl flow, the inlet portion including an inlet port formed at the side wall of the housing; and an outlet portion having an outlet port formed at the upper wall of the housing for expelling the swirl flow through a circumferential end portion thereof and allowing the first fluid to flow into a center portion of the swirl flow through a corresponding center portion of the outlet port, the expelling swirl flow and the inflowing first fluid generating an acoustic energy having a resonance that mixes the first and second fluids; and a guide post for providing stability to the swirl flow, the guide post having an oval cross section for reducing flow resistance and extending from the lower wall of the housing upward toward the outlet portion such that said second fluid incoming through the inlet port strikes a side of said guide post and is then directed in an essentially circular flow around said guide post and ultimately upward toward the outlet portion.

2. The apparatus as recited in claim 1, wherein a ratio between a height of said chamber and a diameter of said inlet port is in a range of 0.5–2.

3. The apparatus as recited in claim 2, wherein the height is approximately 30 mm and the diameter is approximately 20 mm.

4. The apparatus as recited in claim 1, wherein the side wall of the chamber is formed with a helical guide portion to facilitate the swirl flow of the second fluid within the chamber, thereby enhancing subsequent mixture of the first and second fluids.

5. The apparatus as recited in claim 1, wherein a change in pressure from an inlet pressure of the second fluid passing through the inlet port and on outlet pressure of the mixed first and second fluids is less than or equal to 2 bar.

6. The apparatus as recited in claim 1, wherein the guide post is tapered to converge toward the outlet portion.

7. The apparatus as recited in claim 1, wherein the second fluid has a gas phase, the first fluid has a liquid phase, and a ratio between a diameter of said housing and a diameter of said inlet port is in a range of 5 to 8.

8. The apparatus as recited in claim 1, wherein the second fluid has a gas phase, the first fluid has a liquid phase, and a height (H) of the chamber, a diameter (D1) of the chamber, a diameter (D3) of the inlet portion, an inlet pressure ($P_{in}$) of the second fluid passing through the inlet port and an outlet pressure ($P_{out}$) of mixed first and second fluids are designed such that $H/D1 \approx 0.5 \sim 2$, $D1/D3 \approx 5 \sim 8$, and $\Delta P(P_{in} - P_{out}) \leqq 2$ bar, with the resonance having a resonant frequency in a range of 2000 Hz to 3000 Hz.

9. A multiphase mixing apparatus using acoustic resonance, the apparatus comprising:

a housing for guiding first and second fluids to form a swirl flow, said first and second fluids being of different phases, the housing having a circular cross section with a side wall, an upper wall and a lower wall so as to form a chamber having a cylindrical shape therein, the upper wall and the lower wall being perpendicular to a force of gravity, the housing being immersed within the first fluid, the housing being formed at the side wall thereof with a helical guide portion, and the housing being formed with a guide post which extends from the lower wall of said housing toward the upper wall of the housing, the guide post being tapered to converge toward the upper wall of the housing;

an inlet portion having an inlet port formed at the side wall of the housing and directed tangentially into the chamber for introducing the second fluid into the chamber at a predetermined pressure so that the second fluid forms the swirl flow and ascends to be expelled; and an outlet portion having an outlet port formed at the upper wall of the housing for expelling the swirl flow through a circumferential end portion thereof and allowing the first fluid to flow into a center portion of the swirl flow through a corresponding center portion of the outlet port, the center portion having a lower pressure than that of the circumferential end portion, a pressure difference between the expelling swirl flow and the inflowing first fluid generating an acoustic energy having a resonance which mixes the first and second fluids.

10. The apparatus as recited in claim 9, wherein the second fluid has a gas phase and the first fluid has a liquid phase, and a ratio between a diameter of said housing and a diameter of said inlet port is in a range of 5 to 8.

11. The apparatus as recited in claim 9, wherein the second fluid has a gas phase, the first fluid has a liquid phase, and a height (H) of the chamber, a diameter (D1) of the chamber, a diameter (D3) of the inlet portion, an inlet pressure ($P_{in}$) of the second fluid passing through the inlet port and an outlet pressure ($P_{out}$) of mixed first and second fluids are designed such that $H/D1 \approx 0.5 \sim 2$, $D1/D3 \approx 5 \sim 8$, and $\Delta P(P_{in}-P_{out}) \leqq 2$ bar, with the resonance having a resonant frequency in a range of 2000 Hz to 3000 Hz.

12. A multiphase mixing apparatus using acoustic resonance to mix a first fluid with a second fluid, the apparatus comprising:

a housing forming a passage having an inlet portion and an outlet portion which meet at substantially a right angle, said housing being immersed within the first fluid, said first fluid and said second fluid being of different phases;

a resonance volume portion adjacent an outlet port of said outlet portion and communicating with said passage, said resonance volume portion having a cylindrical shape which interacts with mixed first and second fluids to generate a resonant acoustic energy;

a circular rod provided within and along said inlet portion for causing the mixed first and second fluids to form a swirl flow, an annular space being formed between said circular rod and the inlet portion; and a plate at a distal end of said inlet portion for colliding with the mixed first and second fluids, said collision generating resonance at a resonant frequency.

13. The apparatus as recited in claim 12, wherein the passage includes an inlet port smaller than the outlet port in size and the resonance volume portion is formed with an opening which is communicated with the outlet port and is oriented in parallel with a streamline along which mixed first and second fluids flow.

14. The apparatus as recited in claim 13, wherein the first and second fluids have liquid and gas phases respectively, a width of said opening of said resonance volume portion is equal to a width of said outlet portion, and when an inlet pressure of the second fluid is in ranges of 0.1 bar to 2 bar and a flowrate of 100 l/min to 500 l/min, the resonance has a resonant frequency within a range of 1000 Hz to 5000 Hz.

15. The apparatus as recited in claim 12, further comprising a screw provided at the outlet port for adjusting a size of an open portion of the outlet port.

16. The apparatus as recited in claim 12, said inlet portion including a helical guide portion to facilitate swirl flow of the second fluid around the circular rod.

17. A multiphase mixing apparatus using acoustic resonance, the apparatus comprising:

a housing for guiding first and second fluids to form a swirl flow, said first and second fluids being of different phases, the housing having a side wall, an upper wall and a lower wall so as to form a chamber therein, the upper wall and the lower wall being perpendicular to a force of gravity, the housing immersed within the first fluid;

an inlet portion for introducing the second fluid into the chamber at a predetermined pressure so that the second fluid forms the swirl flow, the inlet portion including an inlet port formed at the side wall of the housing;

an outlet portion having an outlet port formed at the upper wall of the housing for expelling the swirl flow through a circumferential end portion thereof and allowing the first fluid to flow into a center portion of the swirl flow through a corresponding center portion of the outlet port, the expelling swirl flow and the inflowing first fluid generating an acoustic energy having a resonance that mixes the first and second fluids;

wherein a height (H) of the chamber, a diameter (D1) of the chamber, a diameter (D3) of the inlet portion, an inlet pressure ($P_{in}$) of the second fluid passing through the inlet port and an outlet pressure ($P_{out}$) of mixed first and second fluids are designed such that $H/D1 \approx 0.5 \sim 2$, $D1/D3 \approx 5 \sim 8$, and $\Delta P(P_{in}-P_{out}) \leqq 2$ bar.

18. A multiphase mixing apparatus using acoustic resonance, the apparatus comprising:

a housing for guiding first and second fluids to form a swirl flow, said first and second fluids being of different phases, the housing having a side wall, an upper wall and a lower wall so as to form a chamber therein, the upper wall and the lower wall being perpendicular to a force of gravity, the side wall being formed with a helical guide portion to facilitate the swirl flow of the second fluid within the chamber, the housing immersed within the first fluid;

an inlet portion for introducing the second fluid into the chamber at a predetermined pressure so that the second fluid forms the swirl flow, the inlet portion including an inlet port formed at the side wall of the housing; and an outlet portion having an outlet port formed at the upper wall of the housing for expelling the swirl flow through a circumferential end portion thereof and allowing the first fluid to flow into a center portion of the swirl flow through a corresponding center portion of the outlet port, the expelling swirl flow and the inflowing first fluid generating an acoustic energy having a resonance that mixes the first and second fluids.

* * * * *